US006644090B2

(12) United States Patent
Gasparini

(10) Patent No.: US 6,644,090 B2
(45) Date of Patent: Nov. 11, 2003

(54) SAFETY TOOL FOR SUPPORTING AND HOLDING AT LEAST ONE INTERCHANGEABLE UTENSIL, PARTICULARLY ON A PRESS-BENDING MACHINE

(76) Inventor: Luciano Gasparini, Via Storti, 11, I-31036 Istrana (IT)

( * ) Notice: Subject to any disclaimer, the term of this patent is extended or adjusted under 35 U.S.C. 154(b) by 0 days.

(21) Appl. No.: 10/158,751

(22) Filed: May 30, 2002

(65) Prior Publication Data

US 2003/0005744 A1 Jan. 9, 2003

Related U.S. Application Data

(63) Continuation of application No. PCT/IT00/00473, filed on Nov. 22, 2000.

(30) Foreign Application Priority Data

Nov. 30, 1999 (IT) ..... TV99A0134

(51) Int. Cl.[7] ..... B21D 5/02; B21D 37/04

(52) U.S. Cl. ..... 72/482.2; 72/482.1; 72/481.2; 72/481.1

(58) Field of Search ..... 72/481.1, 481.2, 72/482.1, 482.6, 482.2, 482.3

(56) References Cited

U.S. PATENT DOCUMENTS 4,315,425 A * 2/1982 Zbornik et al. ..... 72/481.2
4,612,796 A * 9/1986 Smyth, Jr. ..... 72/481.2
5,022,256 A 6/1991 van der Meulen ..... 72/481
5,782,308 A * 7/1998 Latten et al. ..... 72/481.6
6,138,492 A 10/2000 Vining et al. ..... 72/481.1
6,467,327 B1 * 10/2002 Runk et al. ..... 72/481.1

FOREIGN PATENT DOCUMENTS

| | | |
|---|---|---|
| EP | 779116 | 6/1905 |
| FR | 2339485 | 8/1944 |
| FR | 2691652 | 3/1954 |

* cited by examiner

*Primary Examiner*—David Jones
(74) *Attorney, Agent, or Firm*—St. Onge. Steward Johnston & Reens

(57) ABSTRACT

Safety tool for supporting and holding an interchangeable utensil, which includes a holding clip, hinged to the utensil support body joined to the beam, the said clip being pushed on one side, while on the other side there are teeth facing the utensil support body, and of which a tooth is used for holding a safety hook and a lower tooth presses against the outer side of a spring for lifting the hook. The safety hook, being positioned between the holding clip and the utensil support body, has a seat on one side, along which the said first tooth of the holding clip is inserted, while on the other side, there is a hooking terminal with a leading plane, that is inserted inside a groove, preferably of the type for utensils with a standard shank.

21 Claims, 11 Drawing Sheets

KNOWN SHANKS

SAFETY TOOL FOR SUPPORTING AND HOLDING AT LEAST ONE INTERCHANGEABLE UTENSIL, PARTICULARLY ON A PRESS-BENDING MACHINE

This application is a continuation of pending International Application No. PCT/IT00/00473 filed Nov. 22, 2000, which designates the United States and claims priority of Italian Patent Application No. 99A000134 filed Nov. 30, 1999.

FIELD OF THE INVENTION

The object of the invention contained herein is a safety tool for supporting and holding a punch in a clamping system, used on the upper beam of a press-bending machine.

The invention has particular, but not necessarily exclusive, application in the press-bending machines sector.

BACKGROUND OF THE INVENTION

There are various types of press-bending machines. They are used in the mechanical engineering industry, particularly for processing sheets of metal in order to obtain, for example, longitudinal sections with various profiles that can be re-worked with a press-bending cycle.

A press-bending cycle consists basically of a bending tool moving down vertically until it presses on a sheet of metal that is positioned on a work-bed, carries out the bending of the sheet, and returns to its original position. To carry out the aforementioned phases, the machine is made up of two parts. The first part, which is usually the upper part of the machine, is mobile, and a second part, which is usually a lower part, is static and positioned perpendicular to the upper part. Regarding the mobile part, during a typical work cycle, a punch, which is made with an interchangeable blade shaped according to the work to be carried out, carries out a vertical return movement by means of a hydraulic cylinder that lowers an upper beam which carries the punch (held in a clamping system) towards a lower beam, on which an interchangeable mould is positioned, followed by a pause and then its return upwards to the original position.

State of the Art

Generally speaking, most press-bending machines currently available on the market have interchangeable punches that make the machine more flexible in order to meet the wide range of requirements for the companies that use them.

According to the type of work to be carried out on the sheet of metal, there are two types of punches. The first one is made up of a single punch, that is, a single monolithic body with a linear blade, which is held longitudinally along the entire length of the upper beam by means of a single clamping system. The second type is made up of a divided or multiple punch, with various elements held by clamping systems to the upper beam. Each element is a single punch, and these punches may even be different from each other. While, with the first type, a single, continuous type of clamping system along the length of the upper beam is required to hold the punch, with the second type, a number of intermediate clamping systems are required according to the number of single punches to be held and clamped.

Regarding the punch itself, it is usually made up of a one-piece metallic body, with a square upper part called the shank, and a lower part that can be any of various shapes, which actually does the bending, perforating, or cutting. The shank is for attaching the punch to the upper beam, and it is the part on which the clamping systems operate. The clamping systems, operated by pneumatic or hydraulic cylinders, or other means of electro-mechanical systems, close one or more plates with a large surface area, thereby clamping and holding the shank of the punch.

The punch or punches have to be replaced more or less frequently, according to the type of work being carried out on the sheet of metal in question. This operation has to be carried out with the machine in a temporary state of arrest, and preferably with the upper beam at an accessible working height for the operator, to make the operation simpler.

To sum up, (see FIGS. 3, 3A and 3B that represent typical applications), whatever the shape of punch or punches used, there are three types of shanks available on the market that are clamped by one or more clamping means to the upper beam:

FIG. 3A shows the original type of shank, indicated as C1. This solution has been abandoned by all the manufacturers because of its lack of safety features. This type of shank has only one tooth that is square and has smooth walls. There is a support surface for the punch adjacent to the tooth, such as, for example, on the head of an clamping device on which the pushing force is distributed perpendicularly.

FIG. 3 shows the Standard-type shank, indicated as C2. This type, for punches with a pressing axis that is not in line with the support shank, has been standardised by all constructors of press-bending machines and punches and, compared to the first type, is characterised by the fact that it has a certain safety feature. This feature is made up of a seat or "C"-shaped continuous groove which runs transversally to the punch at the base and on one side of the shank, into which a holding tooth of the clamping device enters. The main function of this feature is to avoid the utensil dropping from its seat when the clamping means of the clamping device is released. A variation of the standard shank has a double safety groove. In this case, on each of the two sides of the shank, there is a groove which runs transversally, similar to the groove used for a single-type safety shank.

FIG. 3B shows the third type, indicated as C3. This type is not as common as the second type, and is only produced by some manufacturers. These "personalised" shanks are designed to be used exclusively on certain makes of press-bending machines and are not interchangeable with other machines. A typical example is the GASPARINI® shank which, compared with the previous examples, is characterised by the fact that it has a wedge-shaped groove, into which the tooth of the clamping means enters and that, when released, allows the shank to be suspended from the upper beam in complete safety until it is manually removed by the operator.

Drawbacks

From the brief description above, it easy to imagine the main problems that the producers are trying to solve. First of all, there is the problem of the time required and the difficulties encountered when carrying out the operation of replacing the punch. This especially true when using the punch C2, which is the type most widely used, because the operator has to withdraw the utensil along one side. This operation is relatively simple if there is enough space at the side of the machine and if there is only one punch to be drawn out from the upper beam. The punch may be quite heavy, thus requiring more than one operator to withdraw it, or may require suitable lifting means such as a winch. The operation becomes much more difficult if the punch is divided. In this case, when the distance between the intermediate devices is less than the length of the punch, it is necessary to draw it out by withdrawing all the punches that precede it, with all the problems that are inherent with this type of operation.

All these operations have to be carried out with the machine in a rest position, which obviously implies that the cost involved will be proportional to the number of interventions that have to be carried out.

A second aspect that cannot be overlooked is the fact that the punches with safety features currently used are not automatically aligned. This problem is quite serious when high-precision components are being manufactured and where the split punches have to be perfectly aligned with each other. With the current technology, such alignment is almost impossible, resulting in operations carried out on the sheets of metal positioned below the punch that are not satisfactory according to current standards.

Amongst the solutions commonly used in order to resolve the first of the problems mentioned above, that is, withdrawing the punch sideways with respect to the upper beam, the insertion of the punch from below, and vice versa for its removal, is becoming common practice. In this case, in order to hold the groove of the safety feature that runs transversally to the standard-type shank, a wedge is used that is pressed into position in the groove by a spiral spring. This solution requires a considerable amount of effort by the operator to overcome the force of the spring, both when inserting or withdrawing the shank of the punch from the clamping means on the upper beam. The main drawback is given by the fact that the spring must be very strong in order to hold the punch in place when it is released, and must provide a strong pushing force perpendicular to the groove.

What is more, regarding the technique described, the force of the spring has to be calculated according to the length of the punch in order to make its movement easy. It is precisely the calculation of the force of the spring that presents a number of problems regarding the setting-up of this mechanism.

There is also a system that is defined as "self-aligning" by the manufacturer. This system has a closing plate with an inclined plane at the end that is tangential to the top of the side of the groove in the shank of the punch. When the plate is brought close, the plane goes against the top of the side of the groove, forcing the punch to go along the diagonal. Even though this solution seems original, it can only be used for punches made up of one single element, while in those cases where divided punches are used, it does not guarantee a uniform anchorage of all the elements, leaving play and leading to misalignment of the punches, which obviously leads to poor quality processing.

U.S. Pat. No. 5,022,256 Discloses a safety tool having a clamping device with a hooking tooth for holding a punch. It provides a resilient strip (6,32) having the hooking tooth (11) for safety purposes.

EP0779116A (AMADA GMBH), FIG. 2 discloses a quick clamping device for at least one tool (punch in the description) of a machine tool, in particular for one bending or edging punch of a bending or edging press, comprising a clamping member and a safety and hold means for the tool (punch), said clamping member being provided with an engagement strip which is pre-tensioned for engagement with a counter-recess in the tool shank and which is attached to be actuated by a central operating member in direction opposite to its tension. The above solution provides the use of an intermediate tool-engaging means (4) between the press-bending up-down-moving upper support (2) and said bending tool or punch and having the features of: hand-operated; missing in-line tool; unlocked positioning means in case of different thickness; dangerous tool extraction because one hand must be under the tool.

FR2339485A (COLLY PIERRE) discloses a lever hooking and locking means for a safety tool to be clamped as a solution close to the previous one. This feature does not provide high-precision and self-alignment and enables use with personalized bending-tools (punches) and side insertion only.

FR26916524 (TREILLET JEAN) discloses a safety tool device directly connected to the upper press-bending support, without intermediate locking safety device. This feature being manual with personalized tools (punches). Realization requiring a very high precision. Recovering in thickness being missing.

In the lever means solutions disclosed in EP0779116A and FR2339485A, a lever hooking and clamping means is disclosed, said lever hooking and clamping means having the fulcrum on the upper end, a clamping action being operated by closing said lever means, by acting on an intermediate portion of it, with an intermediate closing screw (in the EP0779116A Ref, 7,8 and in the FR2339485A Ref.3-6 assisted by side-counter-springs 7): In this way, the hooking of the bending-tool or punch is made operative, but with a force that is ½ of the closing force in its intermediate portion.

With regard to the above, and other techniques that are less widely used, the applicant believes that the means for holding the punch can be greatly improved with regard to operator safety.

BRIEF DESCRIPTIONS OF THE INVENTION

This and other aims are achieved with a safety tool for supporting and holding at least one interchangeable punch having a shank with a first groove to an upper beam of a press-bending machine, comprising: a first clamping device adapted to be joined to the beam, the clamping device having a support body, a holding clip joined to the support body, and a safety hook joined to the holding clip, the safety hook having at one end a hooking tooth for engaging the groove of the shank of the punch, wherein the holding clip has a plurality of holding clip teeth adjacent the support body for engaging the safety hook and wherein a first one of the holding clip teeth, when engaging the safety hook, supports the safety hook and wherein a second one of the holding clip teeth, when engaging the safety hook, exerts a force on the safety hook, such that the safety hook is pressed against the shank.

Advantages

In this way, through the creative contribution of the system which leads to an immediate technical progress, various advantages are achieved.

In particular, the safety tool mechanism for holding the punch is extremely flexible since it can be applied to the upper beam on any press-bending machine currently used. It is extremely efficient and functional because it can be applied in all those situations where clamping devices used for clamping standard safety shanks are foreseen.

Going into detail, there are considerable advantages for the operator of the machine, who can carry out removal of the punch from the upper beam in complete safety with a very simple operation that, above all, allows the operator to perceive the moment in which the punch is unhooked and released from above to below slightly in advance. At the same time, the insertion of the chosen punch in the intermediate positions along the beam from below can be performed, which is an operation that can be carried out very quickly and without any particular effort by the operator.

Regarding safety, each punch is moved laterally using either one or both hands, and unlike in the previous systems, along the line of the press, thus offering maximum protection against work accidents.

Among the advantages that are worthy of note, there is an unrivalled self-aligning capacity of each punch with the other split punches along the horizontal and vertical axes when using this system, so that extremely precise pressing operations can be carried out and thus considerably improving the overall quality of the finished product.

The elimination of play and the stability of the punch after closing the holding clip further improve the quality of the process. The system, right from the initial contact with the sheet of metal to be processed, eliminates the small movement along the vertical axis of the punch that is perceived when using traditional clamping systems. Furthermore, since the system has no play, the operator has an impression of working with a reliable tool, thus leading to a natural sensation of operating under safe working conditions.

The overall safety is considerably improved since the punch, when released, can not fall even if it oscillates laterally, whether in one direction or another, as may accidentally occur in the systems described previously.

Because of the presence of the hooks, which are more or less equal in length to the clamping devices, the punch is hooked more safely because, if one or more of the hooks are no longer operational, there are the remaining hooks that hold the punch very efficiently.

Furthermore, because of the adoption of certain measures, there is a uniform holding of the punch, which is distributed evenly along the entire surface of the shank of the punch. At the same time, by modifying the mechanism for operating the holding clip, the hold is also more uniform when only one clamping system is used to clamp a single punch to the upper beam.

These and other advantages will be explained in the following detailed description and attached drawings of various applications of the system, which are to be considered simply examples and not limitations of the system.

DESCRIPTION OF TYPICAL APPLICATIONS OF THE INVENTION

By referring to the illustrations, it can be said that a press-bending machine is made up of an upper part and a lower part. The upper part is mobile while the second part is static. In the first part, there is an upper beam that moves along a vertical axis and which, longitudinally, by means of an clamping device (A) with a self-aligning holding mechanism, holds an interchangeable punch (1).

Figure 21:
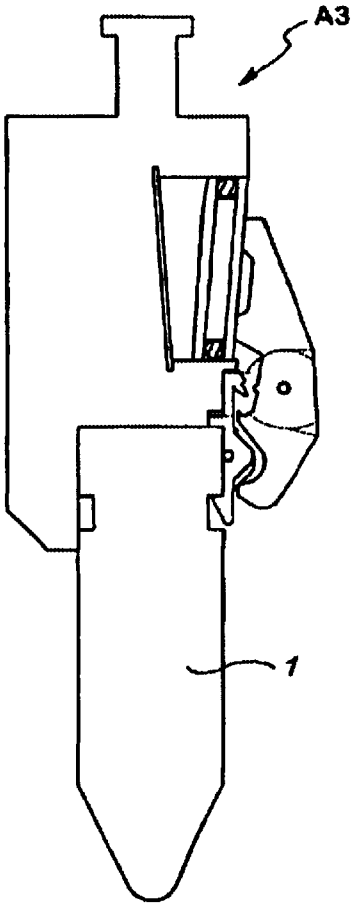
Figure 24:
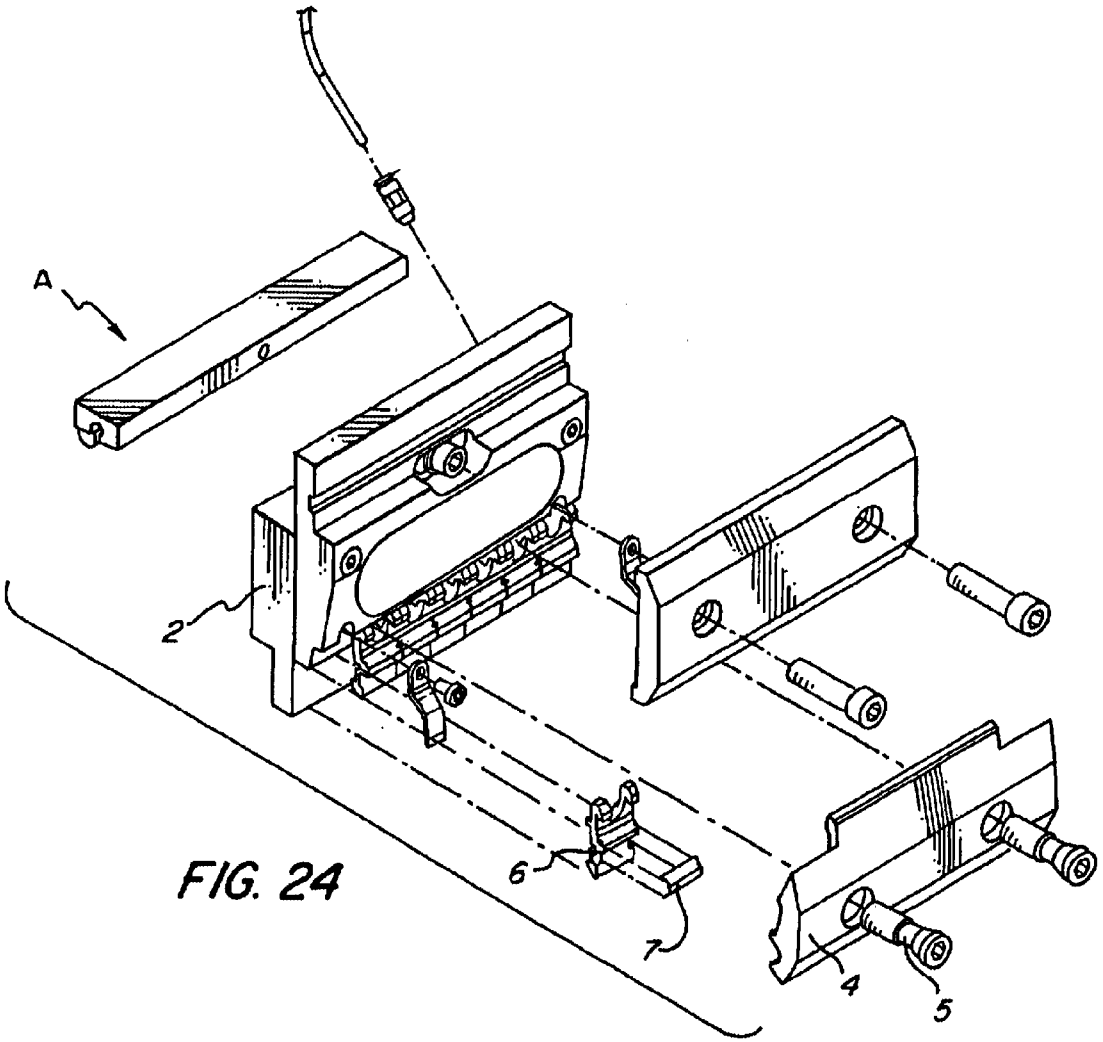
FIG. 24 represents an exploded view of the system.

The punch (1) is made up of a metallic monolithic body, which, on the lower end, makes up the forming edge (11) used for pressing against the sheet of metal. On the upper end there is a shank (12) with a "C"-shaped (13) groove along one side (122), which acts as a safety device. Going further into detail, the shank (12) of the punch (1) can be either non-axial (see FIGS. 1 to 2 and 4 to 17) or axial with respect to the load axis, as shown in FIGS. 21.

A first example foresees an clamping device (A) made up of a metallic support body (2) with an attachment (21) to the upper beam of the press-bending machine on the upper side. The lower part of the support body (2) has a vertical reference plane (22) along which, in taking up the punch (1), the corresponding flat surface on the side (121) of the shank (12) is positioned.

Halfway along, the support body (2) has a chamber under pressure (23) in the case of a pneumatic type, which pushes and draws back a piston (3) with a perimeter seal (31). The purpose of the piston (3) is to act upon the upper end (42) of a holding clip (4), which, by means of jointed screws (5), is hinged to the support body (2). The aim of the holding clip (4) is to transfer the push of the piston (3) to the lower end (41) of the holding clip, which on the inner side has a particular conformation.

Going further into detail, the said lower end (41) of the holding clip (4) has at least two longitudinal parallel teeth (411) and (412) which face the same side. The upper tooth (411) has a groove (413), on the inside of which the upper portion (61) of a safety hook (6) is inserted. The second (412) of the two teeth, with both of them facing towards the body of the support body (2), coincides with the lower edge of the holding clip (4). This tooth (412) is similar to a half round lip which sticks out towards the surface (22) of the support body (2). The purpose of this tooth (412) is to press on the outer side of at least one spring (7) for lifting the hook (6), the said spring having a "V"-shaped conformation. The said spring (7) is made of spring steel and partially overlaps and joins, by straddling, a corresponding male protrusion (63), which serves as a body, transversally formed into the safety hook (6). Between the spring (7) and the back (63) of the hook (6) there is a certain amount of play, so that the spring (7), when acted upon by the tooth (412), is deflected in a controlled manner, thus guaranteeing the hook's (6) adherence to the shank of the punch, and its pressure against the support body (2).

Finally, there is at least one intermediate safety hook (6). It is positioned between the flat reference surface (22) of the support body (2) and the lower end (41) of the holding clip (4), and is partially involved by the positioning of the lifting spring (7) of the hook (6). The conformation of the safety hook (6), which is made up of monolithic metallic body, is formed in such a way as to have two symmetrical spikes (61) along the upper side, that stick out and face the holding clip (4). The two spikes (61) temporarily act upon the holding clip (4) by sitting inside the groove (413) formed along the respective tooth (411). Below the spikes, there is the body (63) facing the same side which supports, in a straddling fashion, the spring (7), leaving a certain amount of space between the two surfaces in order to allow the spring a certain amount of movement to adapt itself when acted upon by the end (412) of the holding clip (4). On the opposite side, that is on the surface of the safety hook (6) facing the surface (22) of the body of the support body (2), a main tooth (62) is formed which also has a hooking function, and with a flat reference and lifting surface (621) and an inclined surface that acts as a lead for the movement (622). In a preferred solution, the safety hook (6) has a an O-ring (64) partially embedded in a respective seat (641) which is formed opposite the protruding body (63) on the side facing the surface (122) of the shank (12) to be clamped. One of the aims of the O-ring (64) is to guarantee that split utensils are well fitted, by compensating for play due to wear of the shank (12) or imprecise manufacturing.

Finally, on the top of the safety hook (6) there is another small tooth (66) that faces the clip (4), which works in conjunction with a catch (414) on the surface of the said holding clip (4). The purpose of this arrangement is that, in conditions where the clip (4) is open with rotation of the punch (1) (see FIG. 8), even if the punch (1) is forced more than that of the force of gravity, the safety hook (6) can not slide upwards. During the release phase of the punch (1), the aforementioned arrangement guarantees (by rotation according to FIG. 13), that the hook is held high during oscillation.

Regarding the preferred solution for moving the clip (4), it can be made mobile along the orthogonal axis with respect to the load axis of the punch along the line of pressing. In this case, there is a series of guides and at least one return cylinder.

FUNCTIONAL DESCRIPTION

Figure 1:
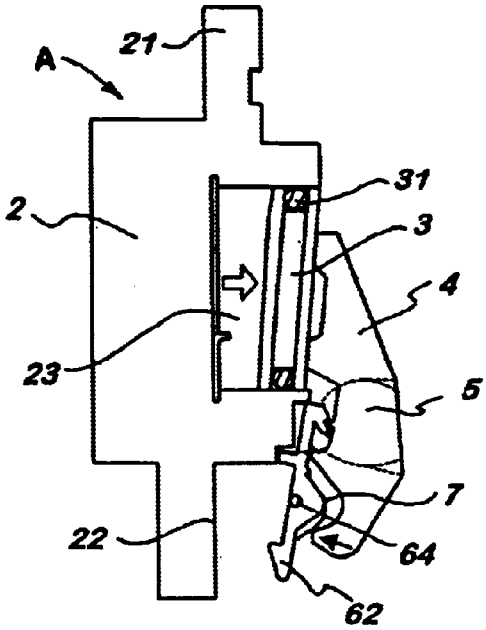
FIG. 1 is a side view of the assembly of a self-aligning device for holding a punch under pressure, without the punch.
Figure 2:
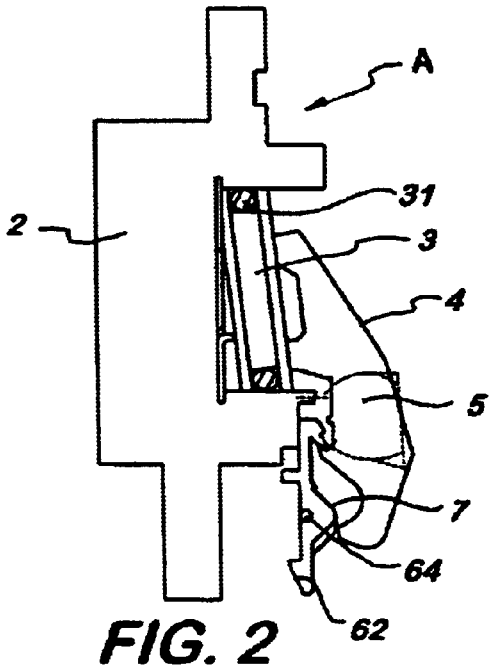
FIG. 2 is a side view of the assembly of a self-aligning set for holding punches at rest, without the punch.
Figure 3A:
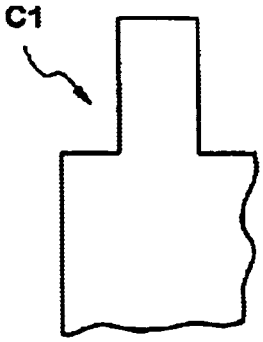
FIGS. 3A and 3B show two other types of punch shanks for reference purposes.
Figure 3:
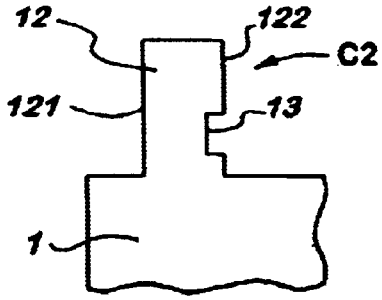
FIG. 3 is a view of a punch shank with a standard safety fitting.
Figure 3B:
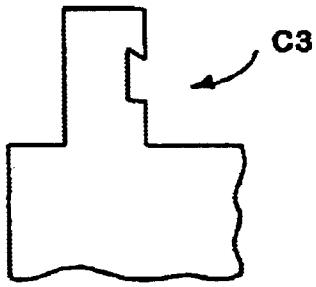
Figure 4:
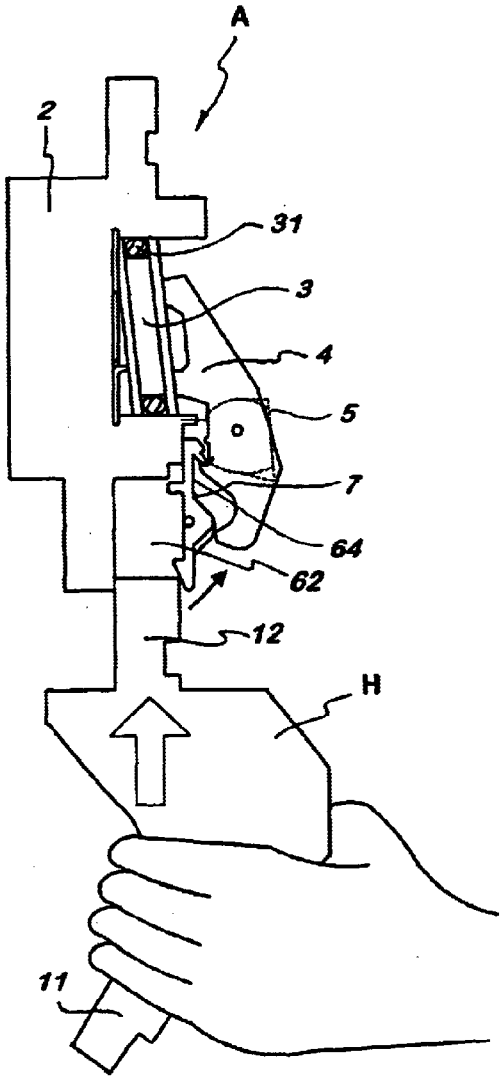
FIGS. 4 to 7 show the sequence for inserting the punch from below towards at least one upper clamping device.
Figure 5:
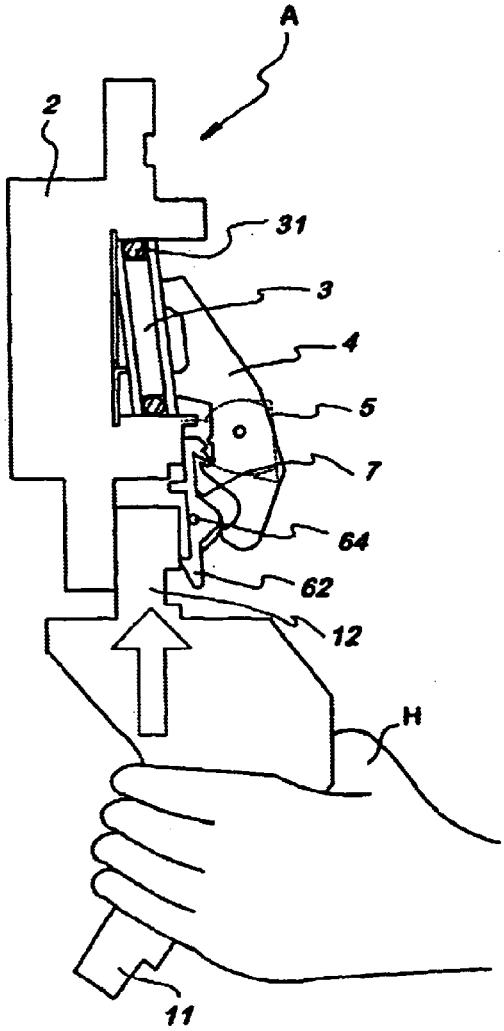
Figure 6:
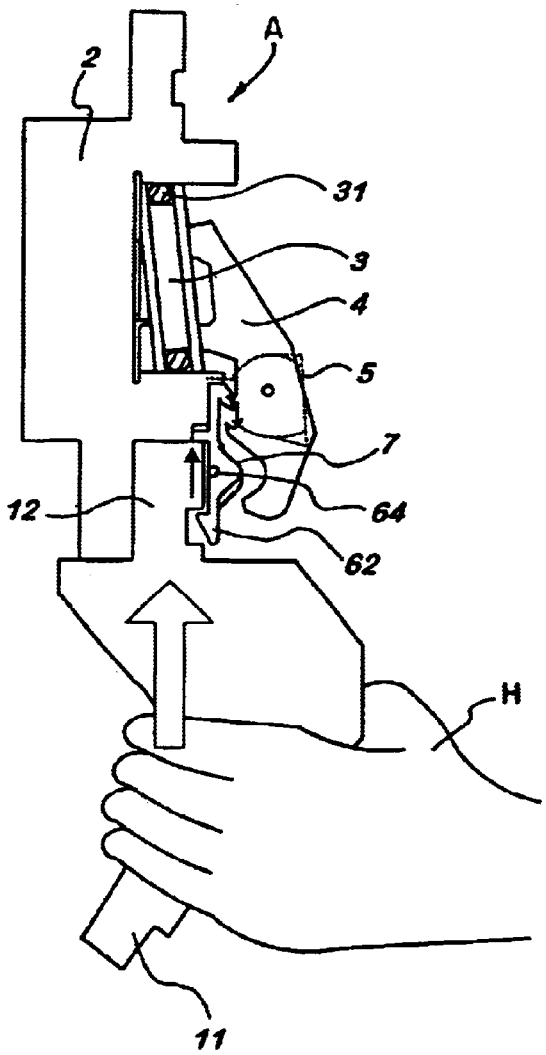
Figure 7:
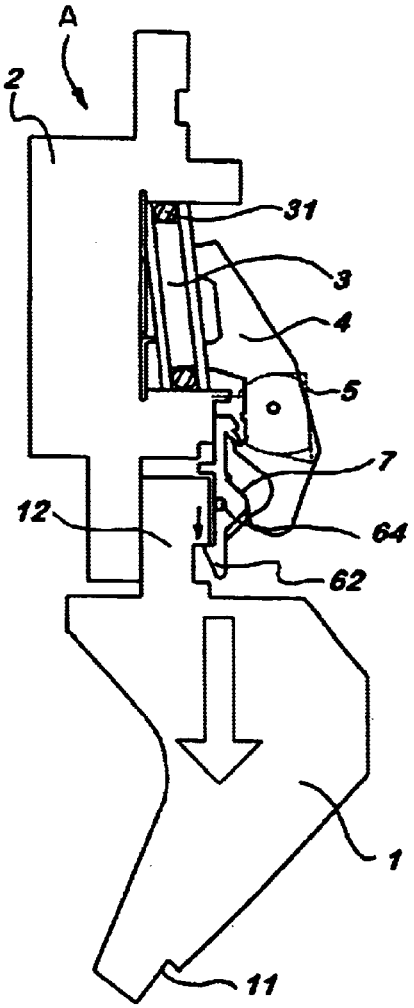
Figure 8:
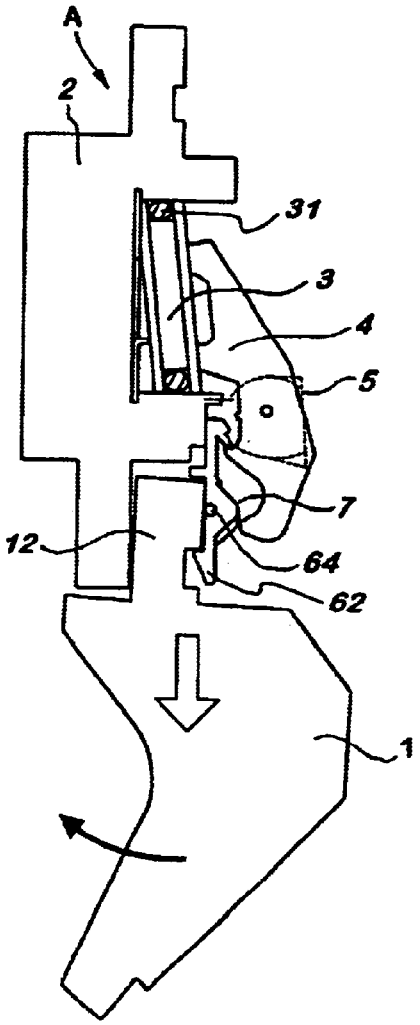
FIGS. 8 to 10 show the sequence for holding the punch shown in the previous figures.
Figure 9:
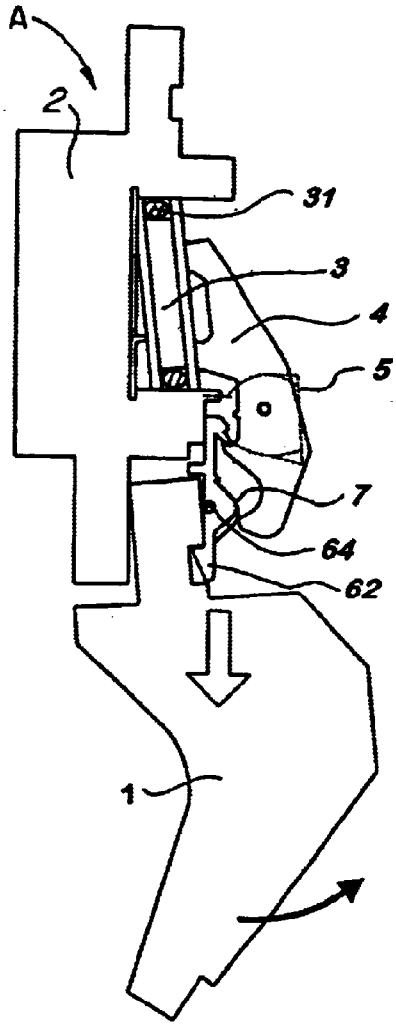
Figure 10:
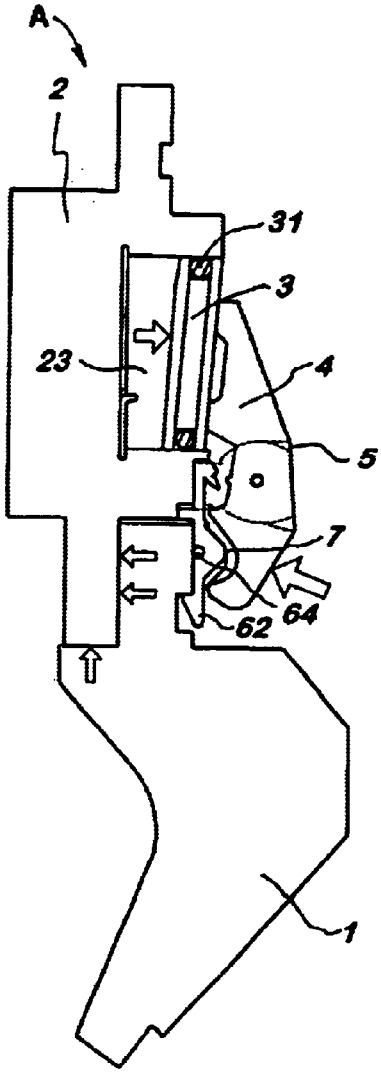
Figure 11:
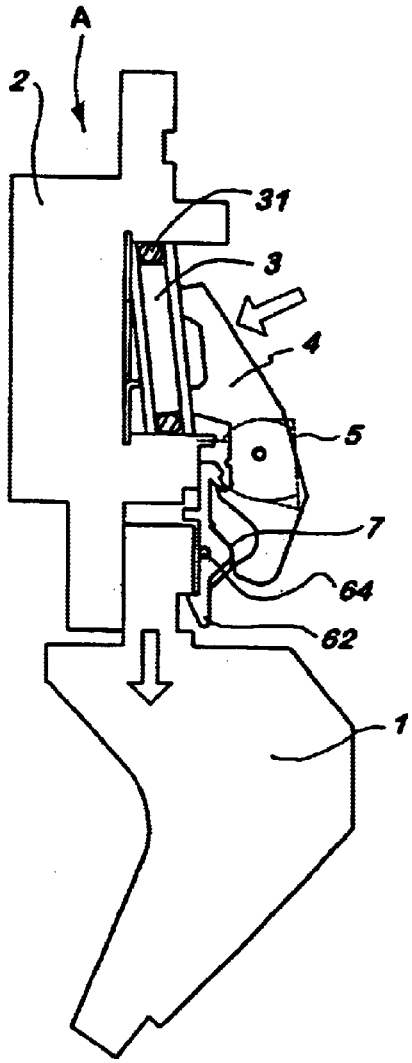
FIGS. 11 to 15 show the sequence for releasing and removing the punch shown in the previous figures.
Figure 12:
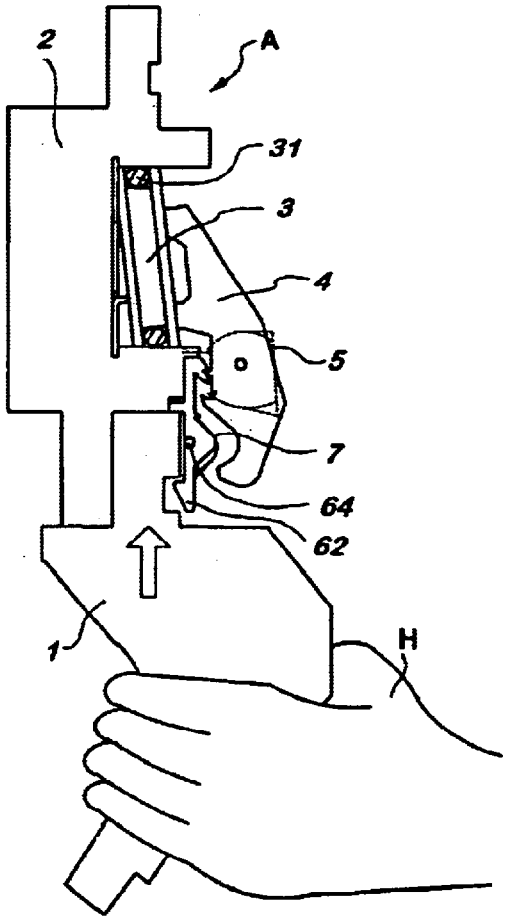
Figure 13:
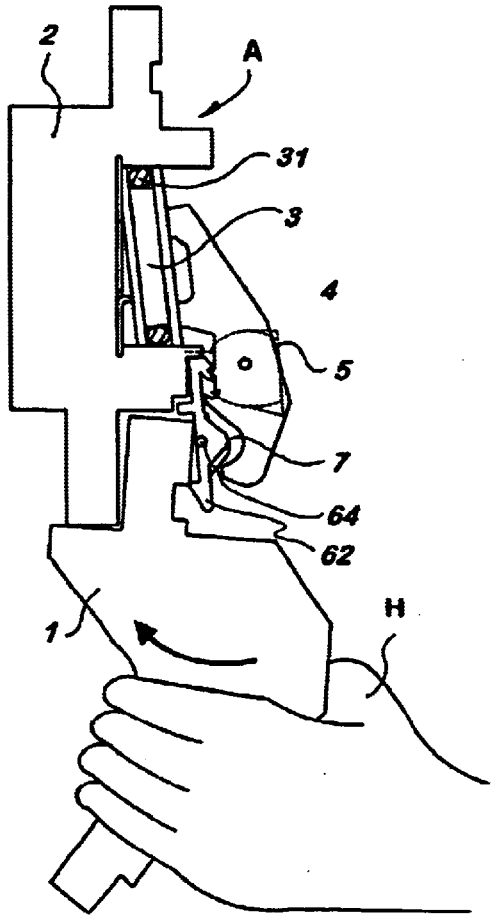
Figure 14:
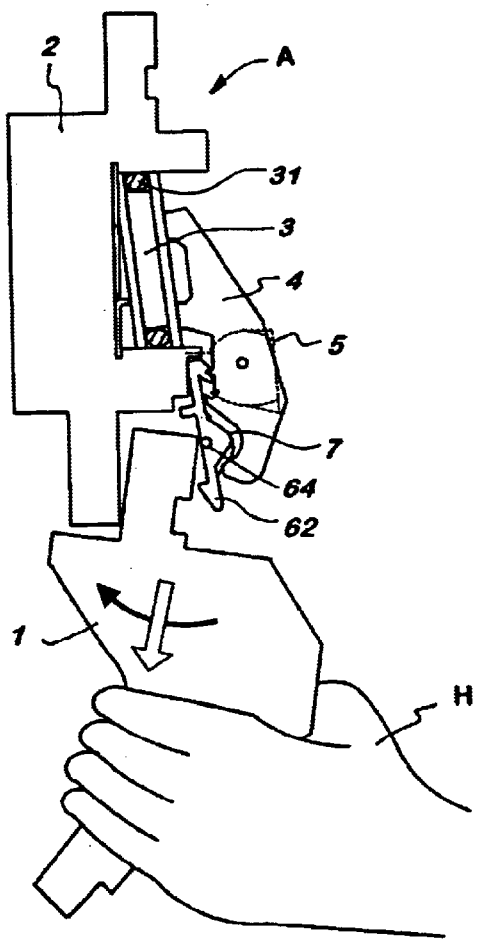
Figure 15:
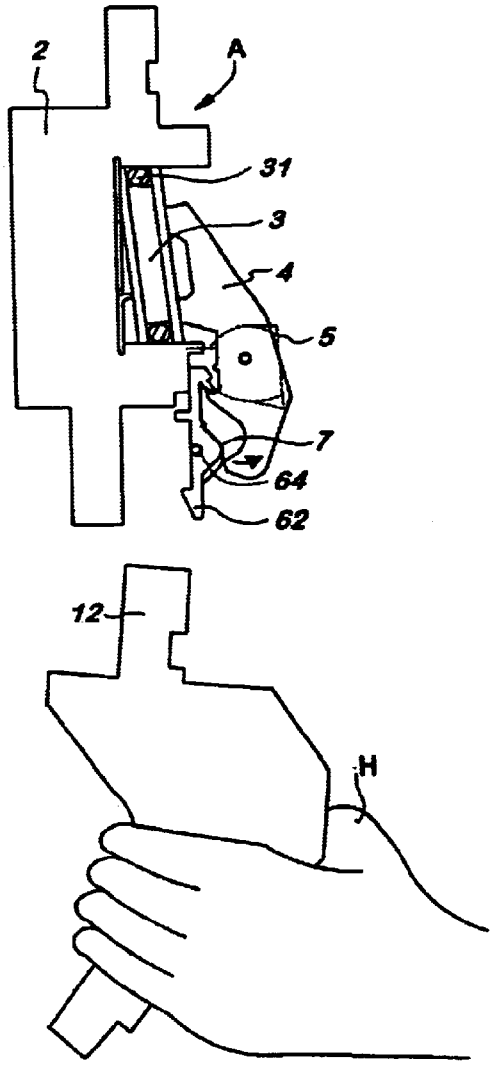
Figure 17:
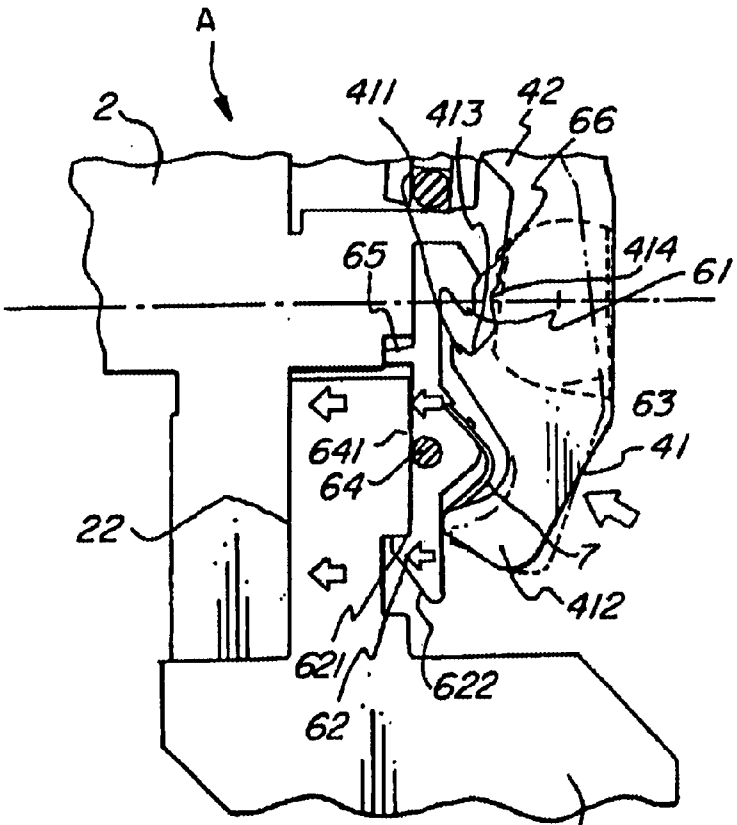
FIGS. 16 and 17 are schematic views of the sequence of the most important phases of the mechanism, and in particular the operations relative to the holding of the punch against the support body, with the first sequence showing the vertical raising of the punch, and the second phase in which the punch, when it reaches its stop, is pushed laterally by means of the spring that presses the hook.
Figure 16:
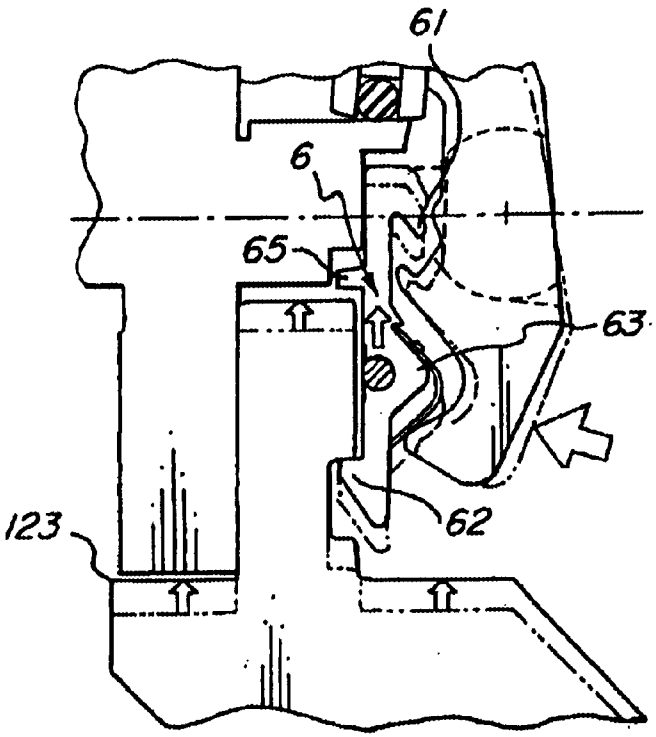

FIGS. 4 to 7 show the phases for inserting the punch (1) along at least one clamping device (A). Going into detail, the operator grips the punch with at least one hand (H) between the shank (12) and the forming edge (11). He then pushes it upwards as indicated in FIG. 4 until the external upper edge sits on the inclined plane (622) of the safety hook (6). By continuing the upward movement of the punch (1) (see FIG. 5) the head of the shank (12) creates a slight misalignment of the intermediate safety hook (6) with respect to the direction of insertion, brought back into line when the upward motion of the punch is continued until the tooth (62) intercepts the groove (13) along the side (122) of the said shank (12).

In this position the tooth (62) is lifted and opened, sliding with the surface of the spring (7) along the surface of the lip (412), leaving a space to insert the punch (1). At this point, the safety hook (6) goes down due to gravitational forces and goes into the groove (13), leaving a certain amount of play.

As a result, if the insertion movement is continued, the safety hook (6) moves back to a perpendicular position to hook the groove (13) with the tooth (62) and pulls the safety hook (6) and punch (1) upwards, until the lower end of the support body (2) goes against the base (123) of the punch (1) from which the shank (12) rises. In this position, the intermediate safety hook (6) is independent from the clamping device (A), while the side (121) of the shank (12) of the punch (1) rests against the reference plane (22) of the support body (2). On reaching this phase, the operator may let go of the punch (1) (see FIG. 7) because, due to gravitational forces, it drops down slightly and pulls the safety hook (6) down, so that the spring (7) fits along the lip (412) to hold the punch (1) tight.

It remains suspended because each spike (61) of every safety hook (6) is inside the groove (413) of the first tooth (411) formed on the inside of the holding clip (4).

In this position, if the punch oscillates in one direction or another (see FIGS. 8 and 9), the particular arrangement of the system keeps the utensil hooked. This specific condition is guaranteed by the presence of the spring (7) joined along one side of the safety inteimediate safety hook (6). The spring (7), if the punch (1) is released in any position, rests pressed on the outside against the lip (412) of the holding clip (4).

By pushing against the holding clip (4) with the piston (3) (see FIGS. 16 and 17), a movement of the end (41) is indirectly obtained. It presses with the lip (412) against the outside of the spring (7), creating a lifting movement of the punch (1), until the base (123) of the punch (1) adjacent to the shank (12) rests against the lower side of the support body (1). In this way, the shank is tightened (see FIG. 10).

The illustrations that follow (FIGS. 11 to 15) show the release phases of the punch (1) from the clamping device (A). In particular, by releasing the pneumatic command, the holding clip (4) opens and releases the punch (1), which drops down due to gravitational forces and is held by the safety hook (6). The operator then holds (H) the punch (1) and pushes it upwards until the tooth (65) is intercepted, an action that pulls the safety hook (6) and releases it from the holding clip (4). This is followed by a rotational movement towards the body of the support body (2) using the edge of the lower side of the body of the support body (2) as a fulcrum, on which the rotation of the punch (1) is carried out. In this way, the outer edge of the head of the shank (12) acts on the intermediate safety hook (6) again and moves out of line and, as a consequence, preliminarily releases the hook (62) from the groove (13). To complete the extraction of the utensil (1), it must be held in a temporary rotational and lowering condition, until the fulcrum on which the movement pivots goes from the flat (123) to the side (121). By continuing with the pulling force downwards the extraction operation is completed.

Figure 19:
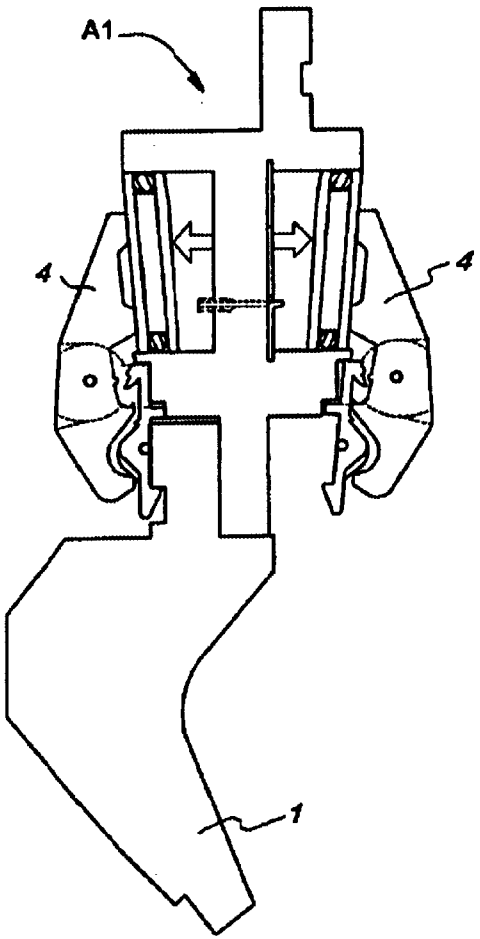
FIGS. 18 and 19 show various ways of applying the safety system to the clamping device in a multiple version, in the first two cases to hold punches with shanks that are not axial and with the forming edge mounted at the front or the back.
Figure 18:
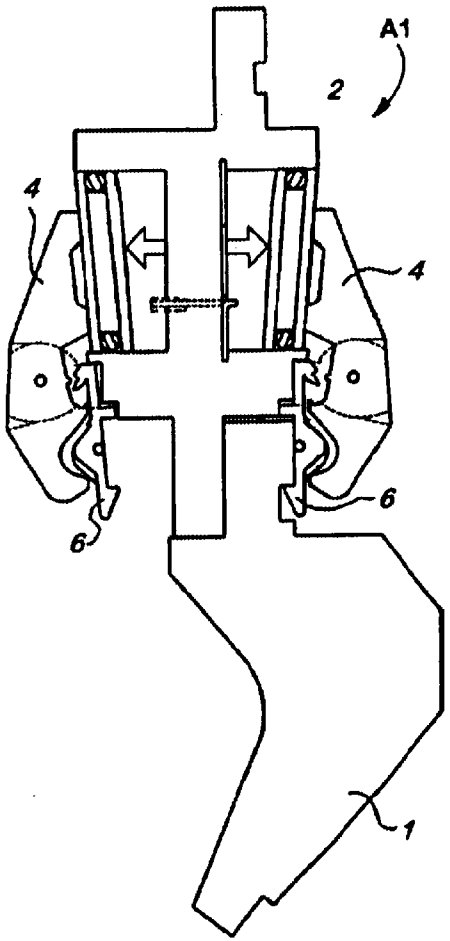
Figure 23:
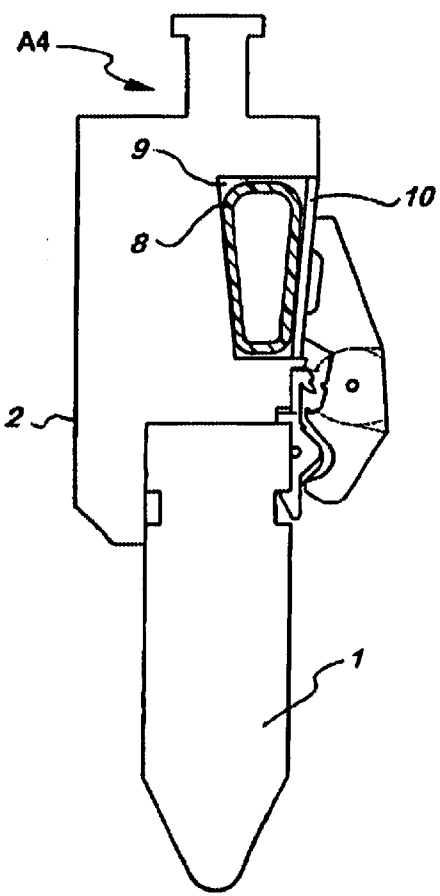
FIG. 23 represents another embodiment of the system of FIG. 21.

The system described above can also be used for a variation, which is often found in the clamping devices for gripping the punch. In particular, this is the A1 type of clamping device, which has a multiple attachment for the punch (1), in this case two, one for each side of the upper beam. These clamping devices, shown in FIGS. 18 and 19, have two mirror-image holding systems and at least one holding clip (4) on each side of the upper beam, which acts upon at least one corresponding safety hook (6) by means of a spring (7) placed in between for lifting the hook, joined to the safety hook (6). In this way, at least one punch (1) can be held on each side, whether fitted to the front or to the back.

Figure 20:
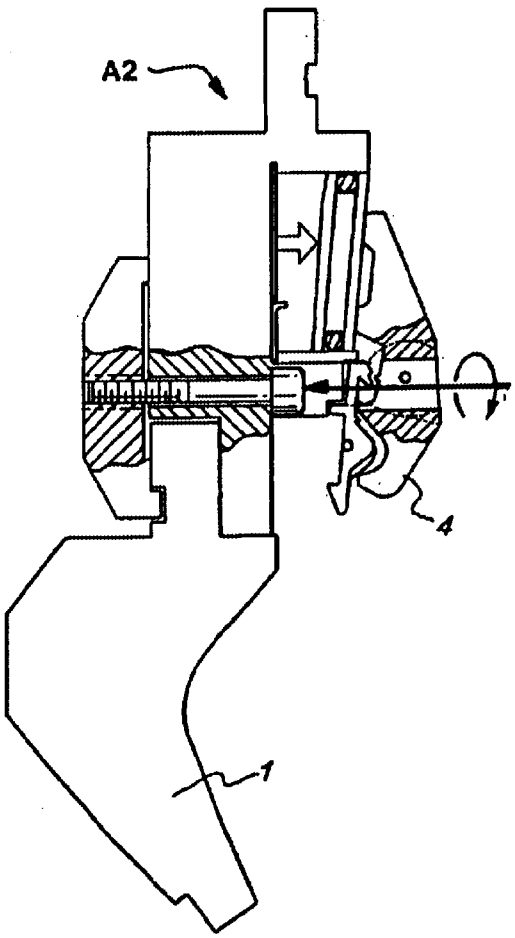
FIG. 20 shows a mixed application of the system with the use of the aforementioned safety system on one side and, on the other side with respect to the clamping device, a traditional plate that is blocked manually.

A further variation foresees a mixed clamping device A2 which is another multiple attachment, differing from the previous one in that it has a holding clip (4) on one side only, while on the other side there is traditional mechanical holding system, by means of a fixing plate for the shank (12), with a fixing screw for the clamping device. With this method, the screw is accessible from the front of the machine to make the operator's work easier (see FIG. 20).

Figure 22:
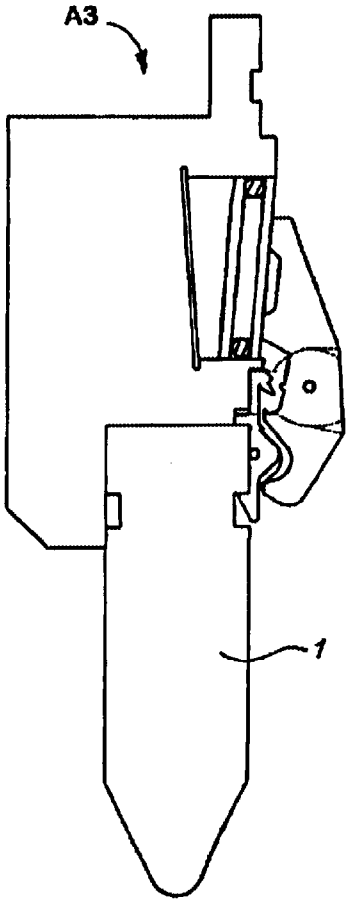
FIGS. 21 and 22 show application variations of the safety system, respectively: an adapted piece for the clamping device with a central attachment and punches with central attachments of the type with a shank that is symmetrical with respect to the load axis (FIG. 21); an adapted piece for the clamping device with an attachment that is not axial with respect to the load axis for a punch with a central attachment of the type with the punch shank that is symmetrical with respect to the load axis (FIG. 22).

FIGS. 21 and 22 show another variation to the clamping device. In detail, this is a first clamping device A3 with an attachment on the upper beam which is axial with respect to the load axis of the punch, and a second clamping device with an attachment on the upper beam which is out of line with respect to the load axis of the punch.

With both solutions the punch (1), with its shank symmetrical to the load axis and with a safety groove (13) on both sides, is held by a clamping unit as previously described, with a holding clip (4) that acts upon at least one corresponding safety hook (6) by means of a spring (7) for lifting the hook, joined to the said safety hook (6). The aim of this type of punch is so that it can be rotated 180°, such as in the case of the punch shown in FIGS. 18 and 19, without having to use two different attachments.

What is claimed is:

1. A safety tool for supporting and holding at least one interchangeable punch having a shank with a first groove to an upper beam of a press-bending machine, comprising: a first clamping device adapted to be joined to the beam, the clamping device having a support body, a holding clip, joined to the support body, and a safety hook joined to the holding clip, the safety hook having at one end a hooking tooth for engaging the groove of the shank of the punch, wherein the holding clip has a plurality of holding clip teeth adjacent the support body for engaging the safety hook, and wherein a first one of the holding clip teeth, when engaging the safety hook, supports the safety hook and wherein a second one of the holding clip teeth, when engaging the safety hook, exerts a force on the safety hook, such that the safety hook is pressed against the shank.

2. A safety tool according to claim 1 further comprising a pneumatic or hydraulic mechanism, for exerting a force on the holding clip such that the second one of the holding clip teeth engages the safety hook.

3. A safety tool according to claim 2, wherein the safety hook further includes a spring for lifting the hook, when the second one of the holding clip teeth engages the safety hook.

4. A safety tool according to claim 3, wherein, when the second one of the holding clip teeth is engaged with the safety hook, the first of the holding clip teeth is disengaged from the safety hook.

5. A safety tool according to claim 4, wherein the safety hook further comprises:

at least one spike for engaging the holding clip;

a safety hook body that supports the spring; and a lifting tooth for lifting the safety hook when the lifting tooth is engaged by the shank.

6. A safety tool according to claim 5, wherein the hooking tooth of the safety hook has a flat reference and lifting surface and an inclined leading surface for lateral movement.

7. A safety tool according to claim 6, wherein the safety hook further includes a seat, further comprising a seal partially inserted in the seat for contacting the shank.

8. A safety tool according to claim 7, wherein the safety hook further comprises a protrusion, wherein the spring for lifting the hook has a "V" conformation and comprises spring steel and mates with the protrusion, and wherein a space exists between the spring and the protrusion, such that, when the second one of the holding clip teeth engages the spring, the safety hook is deflected in a controlled manner.

9. A safety tool according to claim 8, wherein the support body comprises an attachment at a first end for connecting the clamping device to the upper beam of the press-bending machine and a surface at a second end against which the punch is positioned.

10. A safety tool according to claim 9, further comprising jointed screws, wherein the holding clip is hinged to the support body via the jointed screws, and wherein the support body of the clamping unit has a piston and a pneumatic chamber under pressure which pushes and draws back the piston to exert a force on the holding clip.

11. A safety tool according to claim 10, wherein the at least one spike abuts the first one of the holding clip teeth when the safety hook engages the holding clip.

12. A safety tool according to claim 11, wherein the second one of the holding clip teeth is located at the lower edge of the holding clip and is a half round lip and sticks out towards the support body of the clamping device.

13. A safety tool according to claim 12, characterized by the fact that the holding clip has a catch which the spike of the safety hook engages.

14. A safety tool according to claim 1, further comprising a second clamping device mounted to the first clamping device, the second clamping device comprising the support body of the first clamping device, a second holding clip joined to the support body, and a second safety hook joined to the second holding clip, the second safety hook having at one end a hooking tooth for engaging a groove of a shank of a second punch, wherein the second holding clip has a plurality of holding clip teeth adjacent the support body for engaging the second safety hook and wherein a first one of the holding clip teeth, when engaging the second safety hook, supports the second safety hook and wherein a second one of the holding clip teeth, when engaging the second safety hook, exerts a force on the second safety hook, such that the second safety hook is pressed against the shank.

15. A safety tool according to claim 1, further comprising, a mechanical holding system comprising a gripping plate for gripping a second shank and at least one screw for securing the gripping plate to the support body.

16. A safety tool according to claim 15, wherein the holding clip has a hole therein, and wherein the at least one screw is accessible via the hole.

17. A safety tool according to claim 1, wherein the support body further comprises an attachment at a first end for connecting the clamping device to the upper beam of the press-bending machine, and wherein the longitudinal axis of the attachment is aligned with the longitudinal axis of the punch when the punch is inserted into the clamping device.

18. A safety tool according to claim 1, wherein the support body further comprises an attachment at a first end for connecting to the upper beam of the press-bending machine, and wherein the longitudinal axis of the attachment is not aligned with the longitudinal axis of the punch when the punch is inserted into the clamping device.

19. A safety tool according to claim 1, further comprising a punch with a AS"C"-shaped groove.

20. A safety tool according to claim 19, wherein the punch has a second groove, located on the opposite side of the punch as the first groove.

21. A safety tool according to claim 20, wherein the sides of the shank are symmetrical with respect to the axis of the punch.

* * * * *